US008061272B2

(12) United States Patent
Taylor

(10) Patent No.: US 8,061,272 B2
(45) Date of Patent: Nov. 22, 2011

(54) MECHANICAL COMMAND TO ARM FUZE

(75) Inventor: Norman C. Taylor, Davenport, FL (US)

(73) Assignee: DSE, Inc., Tampa, FL (US)

( * ) Notice: Subject to any disclaimer, the term of this patent is extended or adjusted under 35 U.S.C. 154(b) by 169 days.

(21) Appl. No.: 12/542,329

(22) Filed: Aug. 17, 2009

(65) Prior Publication Data

US 2011/0036258 A1 Feb. 17, 2011

(51) Int. Cl.
*F42C 15/26* (2006.01)

(52) U.S. Cl. ..... 102/235; 102/237; 102/245; 102/256

(58) Field of Classification Search ..... 102/222, 102/226, 228, 231, 232, 233, 235, 237, 238, 102/244, 245, 247, 248, 251, 254, 255, 256
See application file for complete search history.

(56) References Cited

U.S. PATENT DOCUMENTS 6,145,439 A 11/2000 Ziemba
7,357,081 B2 4/2008 Zinell et al.
7,461,596 B2 * 12/2008 Zinell et al. ..... 102/235
7,798,064 B1 * 9/2010 Taylor ..... 102/251

* cited by examiner

*Primary Examiner* — James Bergin
(74) *Attorney, Agent, or Firm* — Ronald E. Smith; Smith & Hopen, P.A.

(57) ABSTRACT

A mechanical safe and arm device for rotating munitions reduces arming scatter so that the "no arm" and "all arm" distance are substantially the same. A first spring holds a flywheel, a pinion gear, and a drive gear against rotation until centrifugal forces cause the spring to release them. The drive gear then rotates, causing rotation of the pinion gear and the flywheel. A post depending from the flywheel strikes and unlocks a second spring that unlocks a pivotally-mounted rotor that carries a detonator. The rotor then pivots and brings the detonator into alignment with a firing pin.

14 Claims, 4 Drawing Sheets

MECHANICAL COMMAND TO ARM FUZE

BACKGROUND OF THE INVENTION

1. Field of the Invention

This invention relates, generally, to munitions. More particularly, it relates to a command to arm fuze that requires no electrical or electronic components.

2. Description of the Prior Art

Modern exploding munitions or rounds are required to carry insensitive explosives that have been specially formulated to prevent explosion resulting from exposure of the munitions or rounds to fire or mechanical abuse during transportation, storage, carrying in the field or any other environment they may encounter up until the moment they are fired from a weapon. Since a round must be "sensitive" if it is to explode upon impact with a target, a safe and arm device (SAD) is required to make the round "sensitive" once it has been fired from the weapon. The SAD does this by controlling the alignment of one or two additional explosive components with the main insensitive explosive which forms an explosive "train," usually located along the centerline of the round.

The first component of an explosive train is a highly sensitive detonator; the second component is a less sensitive lead explosive, and it is not always required. The third component is an even less sensitive main charge. If all of the explosive components are in axial alignment with one another when the projectile hits a target, a firing pin detonates the detonator and the explosion of the detonator causes explosion of the lead charge and the explosion of the lead charge causes explosion of the main charge. The explosive train is interrupted and the round will not explode if the detonator or lead explosive is not in alignment with the main explosive.

It is conventional to align the lead explosive and the main charge on the centerline of the projectile and to position the detonator off center until after the round is fired. Movement of the detonator by the SAD from the off-center, or safe, position to the centerline is called "arming." The round and its fuze are armed when the detonator is in alignment with the other explosive components.

A SAD and fuze are usually designed to arm at a specific distance (range) from the weapon that fires the round. The arming range must be sufficiently far from the weapon to ensure the safety of the operator should the round hit a target and explode at the exact instant the fuze arms. Due to inherent variations from fuze to fuze, the range at which they arm can vary greatly. After testing multiple rounds, a "no-arm" range and "all-arm" range can be determined for a given type of fuze. Based on the test data, the "no-arm" range is defined statistically as the range from the weapon at which no fuze will ever be armed. The "all-arm" range is defined as that at which all fuzes will be armed. The spread between the no-arm and all-arm ranges can vary greatly. For example, a M549 fuze may vary from sixty feet (60 ft) (no-arm) to two hundred feet (200 ft) (all-arm).

A fuze that has little or no spread between the no-arm and all-arm ranges is defined in the industry as a "command to arm" fuze. There is a great need for a command to arm fuze due to the close engagement distances of urban warfare. Many times an intended target may be beyond the no-arm range, but well within the all-arm range of a fuze. In this case, the gunner cannot rely on the effectiveness of fired ammunition because some of the rounds will not have armed when they hit the intended target. If the all-arm range can be brought closer to the no-arm range, the weapon will be more reliable and useful over its operating distances.

Conventional mechanical fuzes such as the M550, M549 and M549A use a "spinning" rotor as the primary component of the SAD. The rotor spins about a pivot shaft that is offset from the centerline of the round. Centrifugal forces move the rotor radially away from the centerline as the round spins during flight. The CG of the rotor is typically offset from the centerline of the round when the fuze is unarmed in a location that will maximize the centrifugal force on the rotor.

The detonator is mounted within the rotor. The rotor and its pivot location are designed such that the detonator is spaced apart from the centerline when the fuze is unarmed. As the rotor spins about the pivot, the detonator moves to the centerline of the round so that it is aligned with the lead and main explosives. The rotor hits a mechanical stop when it is so aligned. The rotor is locked in the unarmed position by at least two independent safety devices that prevent it from rotating until the round has exited the weapon. A minimum of two safety devices are required by military specifications governing fuzes.

If not restrained, the rotor moves from the unarmed to the armed position in a small fraction of a second on the order of one-thousandth of a second (0.001 s). This unrestrained arming time is due to the centrifugal force resulting from the mass of the rotor and detonator. Given the velocity of a 40 mm high velocity grenade when it exits the weapon, the goal of an SAF is to arm the round in one-tenth of a second (0.1 s) to ensure an arming distance of approximately eighty feet (80 ft). Therefore, unless the rotor is somehow slowed down, the SAD will arm much too quickly.

The speed of the rotor is slowed down by mechanisms that absorb the kinetic energy of the rotor. A classic version of this mechanical absorber is known as a verge and pinion/starwheel. The starwheel is a small rotating disk that is coupled to the rotor via a pinion mounted upon the shaft of the disk. Gear teeth on the rotor spin the starwheel as the rotor moves from the unarmed to the armed position. The spinning starwheel repeatedly strikes a cam, called a verge, causing it to oscillate about a pivot shaft. The starwheel/verge system converts potential energy stored by the rotor to kinetic energy in discrete increments, acting as a brake to slow down the spinning (pivoting) of the rotor. Friction between the various mechanical components of the SAD also absorbs much of the energy of the rotor. Sources of friction include the pivot shafts about which the rotor, starwheel and verge rotate. These shafts are usually positioned radially outwardly from the centerline of the round.

Due to centrifugal forces on the respective CG's of the rotor, starwheel and verge, the loads on these shafts can be as much as fifteen hundred (1,500) times the force of gravity. Unfortunately, friction is not easy to characterize due to its variability in different environments; the coefficient of friction between two materials can vary by as much as 100% over a small temperature range. Moreover, the tolerances of the respective components can dictate how tightly they rub together. Accordingly, small variations in tolerances can result in large variations in the amount of friction. This friction problem cannot be easily addressed by adding lubrication to the system. In fact, adding conventional lubrications such as oil can actually cause the SAD to bind and stop functioning. The only practical means of lubricating the SAD is by the use of small, precise amounts of dry Teflon® powder; however, the powder application method must be tightly controlled or the treated SAD's may bind and not function.

Electronic SAD's have been developed, but they are not yet used in mass quantity production. An electronic timer could be used to initiate the arming very precisely and assure a Command to Arm fuze; however, some actuation system is still required to actually move the detonator from the unarmed to the armed position. Battery shelf life has also been a concern that has yet to be adequately addressed. The largest impediment for electronic fuze acceptance remains the cost of production in large quantities.

However, in view of the prior art taken as a whole at the time the present invention was made, it was not obvious to those of ordinary skill how the identified needs could be fulfilled.

SUMMARY OF THE INVENTION

The long-standing but heretofore unfulfilled need for a mechanical command to arm fuze is now met by a new, useful, and non-obvious invention.

The novel command to arm fuze includes a hollow housing, commonly called an ogive, having a rounded leading end, an open trailing end, and a longitudinal axis of symmetry. A cylindrical upper housing having an open top and an open bottom is disposed within the hollow main housing in concentric relation to the longitudinal axis of symmetry. A lower housing is disposed within the hollow main housing in concentric relation to the longitudinal axis of symmetry and has a flat bottom wall and a cylindrical sidewall mounted about the periphery of the flat bottom wall, projecting upwardly therefrom in supporting relation to the cylindrical upper housing.

A centrally bored flywheel is rotatably mounted in the upper housing about an axis of rotation that is concentric with the longitudinal axis of symmetry. The flywheel has a center of gravity concentric with its axis of rotation. A timing post depends from the flywheel into the lower housing in eccentric relation to the longitudinal axis of symmetry.

An actuator dome having a central aperture formed therein has a peripheral edge that engages the interior surface of the ogive.

A firing pin is slideably received in the central aperture of the actuator dome and in the central bore of the flywheel in coincidence with the longitudinal axis of symmetry.

A zip rotor positioned atop the bottom wall of the lower housing is rotatably mounted about an axis of rotation defined by a rotor shaft and has a center of gravity eccentric to its axis of rotation. A detonator is mounted in the zip rotor. The zip rotor has a first, unrotated, safe position of repose where the detonator is misaligned with the firing pin.

A first spring prevents the flywheel from rotating when centrifugal forces acting on the first spring are below a preselected threshold and a second spring holds the zip rotor in its safe position of repose even when the centrifugal forces are great enough to cause the first spring to disengage. The first spring has a first end permanently secured to a cylindrical sidewall of the upper housing and the first spring has a second end releasably secured to the flywheel. The first spring could also engage the timing post. The first spring is biased radially inwardly and the bias is overcome when centrifugal forces acting on the first spring exceed the predetermined threshold so that the flywheel is free to rotate about the firing pin.

The flywheel has a central hub and a pinion gear is mounted on the central hub for conjoint rotation therewith. A rotatably mounted drive gear has teeth that meshingly engage the pinion gear so that when the flywheel is held against rotation by the first spring, the drive gear is also held against rotation.

The drive gear is rotatably mounted about a pivot shaft and has a center of gravity eccentric to the pivot shaft. The drive gear rotates in a first rotational direction about the pivot shaft when the first spring releases the flywheel and hence the pinion gear. The pinion gear and flywheel are driven by the drive gear teeth to rotate in a second rotational direction opposite to the first rotational direction when the drive gear rotates in the first rotational direction.

A second spring holds the zip rotor against rotation. The second spring has a first radially outward end permanently secured to a cylindrical sidewall of the lower housing and a second radially inward end releasably engaged to the zip rotor.

A timing post depends from a peripheral edge of the flywheel. The timing post abuts the second end of the second spring and knocks the second end out if its releasable engagement with the zip rotor when the flywheel is rotated in the second rotational direction.

The zip rotor center of gravity causes it to pivot from its safe position of repose to an armed position when released from the safe position of repose by the timing post striking the second end of the second spring. The detonator enters into axial alignment with the firing pin when the zip rotor is in the pivoted, armed position.

An actuator is formed integrally with the hollow housing on an interior side of the rounded leading end. The actuator is centered on the longitudinal axis of symmetry and is closely spaced apart from a head of the firing pin. When the hollow housing impacts against a hard target, the leading end of the hollow housing is deformed and the trailing end of the actuator is driven into the head of the firing pin.

A mounting pin depends from a bottom edge of the upper housing and is received within a bore formed in an upper edge of the lower housing.

A support arm has a first, radially outermost end secured to the mounting pin and a second, radially innermost end disposed radially inwardly from the mounting pin. A firing pin aperture is formed in the second, radially innermost end of the support arm and the firing pin extends through the firing pin aperture.

A rotor shaft is mounted in upstanding relation to the flat bottom wall of the lower housing. More particularly, a first end of the rotor shaft is mounted in a blind bore formed in the flat bottom wall and a first rotor shaft aperture is formed in the zip rotor. A second rotor shaft aperture is formed in the support arm and the rotor shaft extends through the first and second rotor shaft apertures.

An anti-creep spring has a first, radially outermost end secured to the mounting pin and a second, radially innermost end disposed in abutting relation to the zip rotor. A rotor shaft aperture is formed in the second end of the anti-creep spring so that the rotor shaft extends through the rotor shaft aperture. When the hollow housing impacts against a soft target and the hollow housing is not deformed by the impact, the actuator is not driven into the firing pin. The zip rotor in its armed position slides along the rotor shaft in the direction of hollow housing travel due to the sudden deceleration of the hollow housing caused by the soft target impact. The zip rotor overcomes the bias of the anti-creep spring and the detonator carried by the zip rotor impacts against the firing pin.

The drive gear is disposed in overlying, substantially parallel relation to the support arm. The pivot shaft is mounted to the support arm in upstanding relation thereto and a pivot shaft aperture is formed in the support arm and the pivot shaft extends through the pivot shaft aperture. The drive gear is pivotable about the pivot shaft.

A setback e-ring is disposed in encircling relation to the hollow housing and the lower housing. A first groove is formed in a peripheral vertical wall of the hollow housing and accommodates a radially outward edge of the setback e-ring. A second groove is formed in a peripheral vertical wall of the lower housing for accommodating a radially inward edge of the setback e-ring. The setback e-ring prevents relative movement between the hollow housing and the lower housing.

A base plate is disposed in underlying, supporting relation to the flat bottom wall of the lower housing. The lower housing has a radially inwardly disposed flange that circumscribes a trailing end of the lower housing and abuttingly engages a trailing wall of the base plate to maintain the base plate in abutting relation to the flat bottom wall of the lower housing.

A bore is formed in a trailing side of said zip rotor and a recess is formed in the base plate. A setback pin having a head and a reduced diameter post is disposed in the recess and the reduced diameter post is disposed in the bore. A bias means holds the reduced diameter post of the setback pin in the recess. The setback pin maintains the zip rotor in the safe position of repose until acceleration forces acting on the round/projectile as it is launched from a weapon overcome the bias of the bias means and causes the reduced diameter post to withdraw from the recess and thereby unlock the zip rotor so that the zip rotor is free to rotate about the zip rotor shaft when said zip rotor is also released by the second spring.

A central aperture is formed in the base plate and a central aperture is formed in the flat bottom wall of the lower housing. A lead explosive is positioned in the central aperture formed in the base plate and in the central aperture formed in the flat bottom wall of the lower housing. A leading end of the lead explosive is disposed in open communication with the detonator and a trailing end of the lead explosive is disposed in open communication with a main charge. Striking the detonator with the firing pin triggers detonation of the detonator, thereby triggering explosion of the lead explosive which then causes explosion of the main charge.

The primary object of this invention is to provide an all-mechanical command to arm device having no electrical or electronic parts.

A closely related object is to provide an all-mechanical command to arm device that changes from a "no arm" configuration to an "all arm" configuration in as little time as an electronic fuze.

Another important object is to meet the foregoing object in an inexpensive way.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
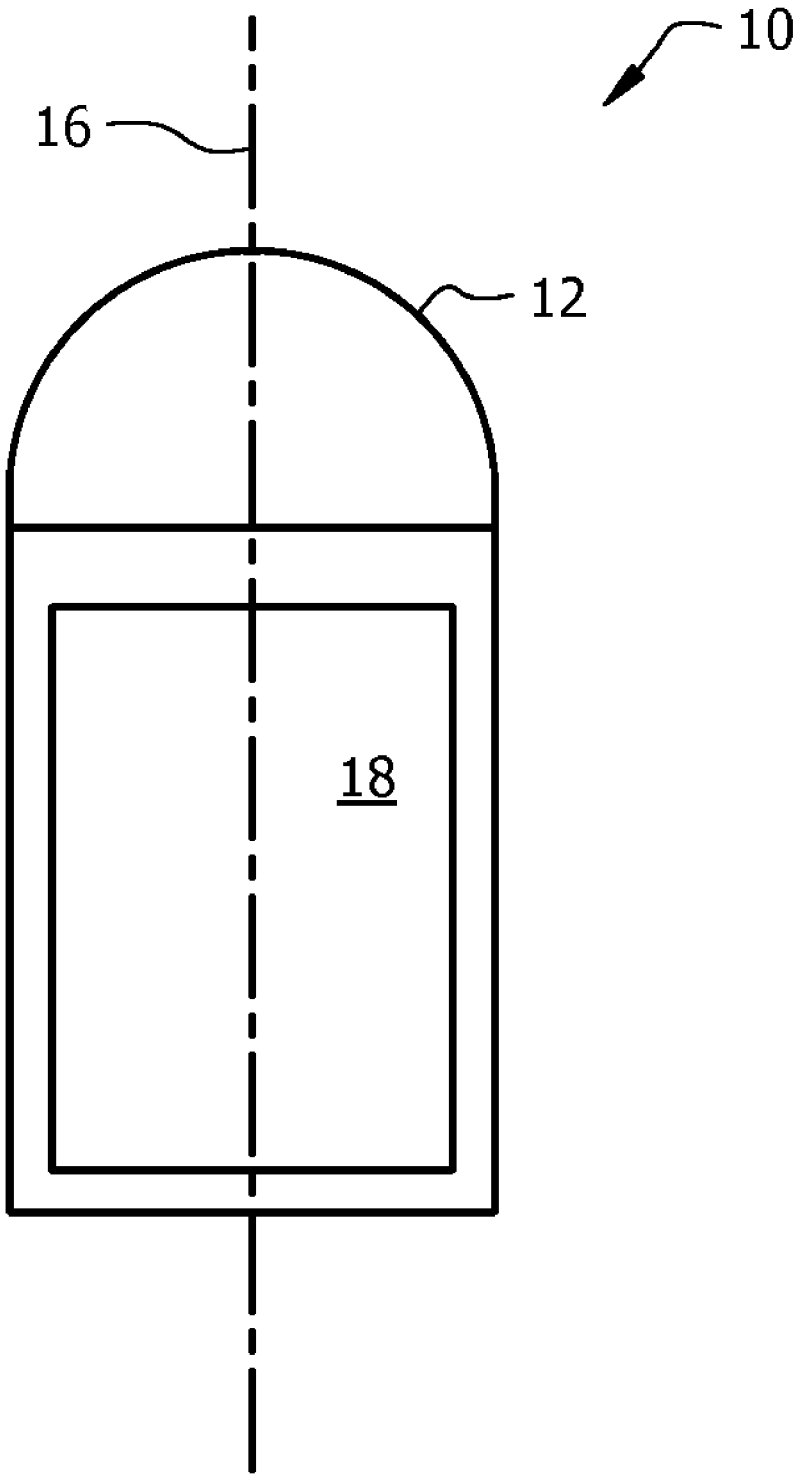
FIG. 1 is a diagrammatic view of a round in flight that is equipped with the novel fuze.

Referring now to FIG. 1, it will there be seen that a diagrammatic representation of a projectile or round equipped with the novel structure is denoted as a whole by the reference numeral 10.

Round 10 in this example is a typical 40 mm round. The novel command to arm fuze is denoted 12. Round 10, having been fired from a weapon, is depicted in flight, travelling in the direction of directional arrow 14. It is also spinning about longitudinal axis of symmetry 16 of round 10 and fuze 12. The trailing end of round 10 is filled with main explosive charge 18. As used herein, the leading end of any part is the end nearest the top of the drawing and the trailing end of any part is the end nearest the bottom of the drawing.

Figure 2:
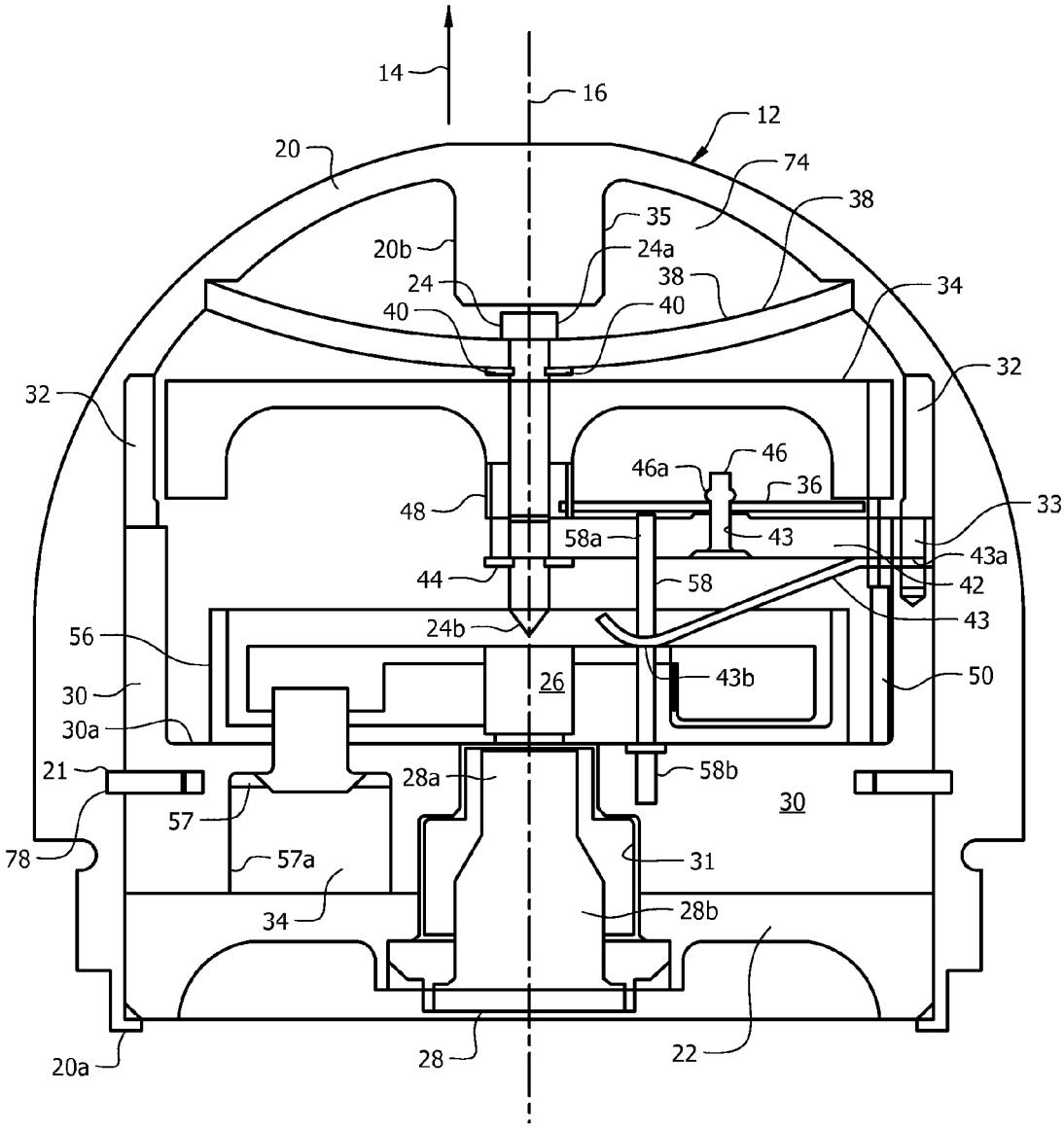
FIG. 2 is a longitudinal sectional view of the novel fuze.

As best understood in connection with FIG. 2, fuze 12 includes hollow housing 20 having a generally inverted "U" shape, sometimes referred to in technical writings as a nosecone or an ogive. Hollow housing 20 houses all of the components of novel fuze 12.

The open trailing end of hollow housing 20 is closed by base plate 22. Radially inwardly-extending crimp **20*a* is formed integrally with hollow housing 20 at its trailing end and circumscribes base plate 22** to hold said base plate to said hollow housing.

Actuator **20*b* is formed integrally with hollow housing 20 at the leading end thereof. Said actuator 20*b* is centered on head 24*a* of firing pin 24. Detonator 26 is centered on point 24*b* of firing pin 24. Actuator 20*b*, firing pin 24, and detonator 26 are all centered on longitudinal axis 16. It should therefore be understood that this FIG. 2** position is the armed position of the fuze. If it were unarmed, the detonator would not be aligned with the firing pin and the actuator.

Impact of 40 mm round 10 with a target begins the detonation process if command to arm fuze 12 has successfully armed. Ogive 20 is crushed if round 10 impacts a hard target. The deformation of ogive 20 drives actuator **20*b* into firing pin 24 which then strikes detonator 26** and initiates a detonation train disclosed hereinafter.

Setback e-ring 21 locks command to arm fuze 12 into ogive-shaped hollow housing 20. As depicted, said setback e-ring is positioned in a groove formed collectively by a groove that circumscribes an inner sidewall of ogive-shaped hollow housing 20 and a coplanar groove that circumscribes an outer sidewall of lower housing 30. Setback e-ring 21 therefore prevents relative movement between lower housing 30 and hollow housing 20. Radially inwardly turned crimp **20*a* at the trailing end of hollow housing 20 performs the same function but setback ring 21** provides a more robust interlocking of parts.

Base plate 22 is centrally apertured to accommodate trailing end **28*b* of lead explosive 28 and said trailing end of lead explosive 28 is attached to said base plate 22. Firing pin 24 is driven into detonator 26 to cause explosion of round 10 as aforesaid. The explosion of detonator 26 causes lead explosive 28** to explode.

Lower housing 30 is positioned atop base plate 22 and cavity or central aperture 31 is formed therein to accommodate leading end **28*a* of lead explosive 28. Aperture 31 is open at its trailing end so that when lead explosive 28 explodes in response to explosion of detonator 26, the blast causes explosion of main explosive charge 18 as best understood from FIG. 1**.

Since the force of the explosion of lead explosive 28 is directed in a trailing direction, i.e., in a direction opposite to direction 14, lead explosive 28 is referred to in the industry as a spitback and base plate 22 is referred to as the spitback and base plate assembly.

Lower housing 30 supports upper housing 32. Upper housing 32 houses flywheel 34 and drive gear 36 which together provide the novel timing means. Flywheel 34 is centrally apertured and firing pin 24 extends through said central aperture and therefore provides a pivot shaft for flywheel 34 so that flywheel 34 is free to rotate about centerline 16. The center of gravity of flywheel 34 is coincident with axis of symmetry 16.

Actuator dome 38 is tightly fit about its periphery to an inner surface of hollow housing 20 as depicted. Actuator dome 38 is centrally apertured and receives the leading end of firing pin 24. Locking e-ring 40 holds firing pin 24 in place.

Pin 33 depends from upper housing 32 and provides a mounting means for support arm 42 and anti-creep spring 43.

Support arm 42 is apertured at its radially outermost end and pin 33 is received within said aperture. Support arm 42 extends radially inwardly from said pin. Flywheel 34 is therefore trapped between locking e-ring 40 and support arm 42. Flywheel 34 and support arm 42 are held onto firing pin 24 by locking e-ring 44.

First, radially outermost end 43*a* of anti-creep spring 43 is secured to mounting pin 33 and therefore abuts the underside of support arm 42. Second, radially innermost end 43*b* abuts the top of zip rotor 56. The bias of anti-creep spring 43 urges zip rotor 56 into abutting engagement with floor 30*a* of lower housing 30. Said bias prevents displacement of zip rotor 56 and hence detonator 26 along rotor shaft 58 into engagement with firing pin 24 while the round is in transit, and said bias is overcome when round 10 strikes a soft target.

Aperture 45 is formed in support arm 42 about mid-length thereof, and aperture 45 is in alignment with an aperture formed in drive gear 36. Pivot shaft 46 extends through aperture 45 and said aperture formed in drive gear 36 so that drive gear 36 is mounted for rotation about said pivot shaft 46. Stop means 46*a* prevents drive gear 36 from traveling in the direction of directional arrow 14. Stop means 46*a* can be an integrally formed enlargement of pivot shaft 46 or it may be a separate mechanical fastener.

Pinion gear 48 is rotatably mounted to a depending central hub that is formed integrally with flywheel 34. It is secured to said central hub and rotates conjointly therewith.

Timing post 50 is also formed integrally with flywheel 34 and depends from an outer peripheral edge thereof. Said timing post extends into the cavity defined by lower housing 30, said cavity housing the arming system of this invention.

FIG. 2 also depicts above-mentioned zip rotor 56 and rotor shaft 58 which extends through an aperture formed in said zip rotor, providing an eccentric pivotal mounting for said zip rotor. Zip rotor 56 rests atop a bottom wall or floor 30*a* of lower housing 30. Leading end 58*a* of rotor shaft 58 is received in a bore formed in support arm 42 and trailing end 58*b* of rotor shaft 58 is received within a blind bore formed in said lower housing bottom wall. Detonator 26 sits within a bore formed in zip rotor 56 and is eccentrically disposed with respect to centerline 16 and firing pin 24 when the fuze is in its safe configuration.

Setback pin 57, also depicted in FIG. 2, is inserted into countersunk cavity 57*a* formed in lower housing 30. A reduced diameter part of the setback pin extends through a bore formed in lower housing 30 and into an aligned bore formed in zip rotor 56. The bore in zip rotor 56 is located such that setback pin 57 can engage said bore only when zip rotor 56 is in its unarmed configuration. A setback spring, not depicted, holds setback pin 57 in place until round 10 is fired from a weapon. When the round is fired, inertial forces acting on setback pin 57 overcome the bias of the undepicted setback spring and force setback pin 57 to displace in the direction opposite to direction of travel 14 of round or projectile 10, i.e., into cavity 57*a*. When setback pin 57 is thus disengaged from zip rotor 56, said zip rotor is free to rotate to the armed position when timing post 50 releases zip rotor release lock spring 60 as disclosed hereinafter.

Figure 3:
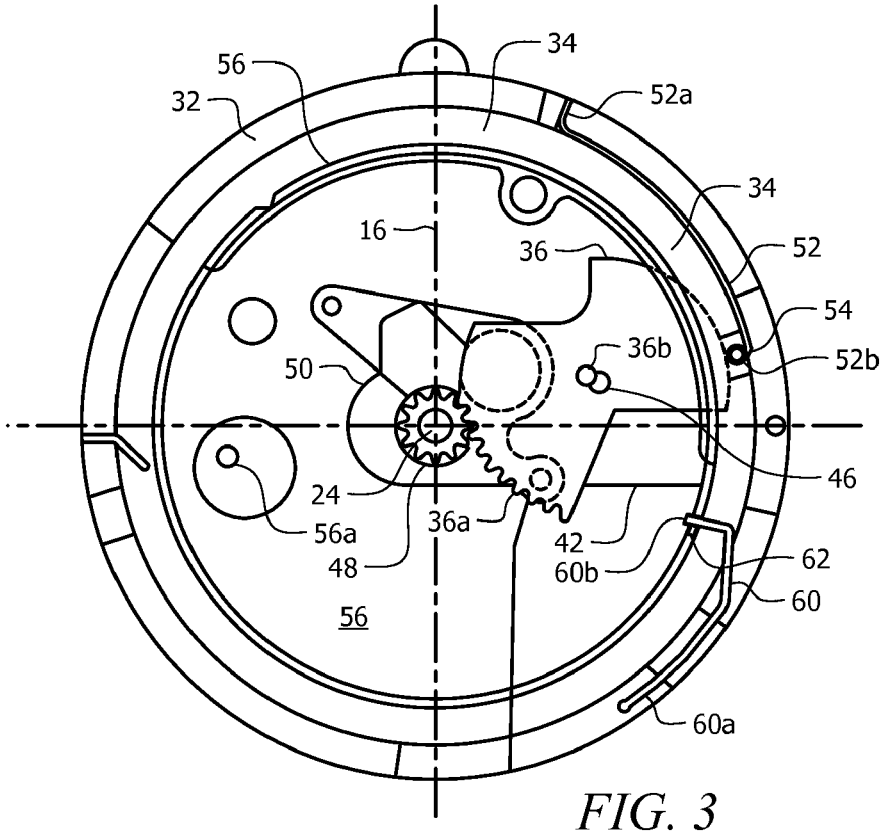
FIG. 3 is a transverse sectional view depicting the fuze in a safe configuration.

FIG. 3 provides a plan view of the configuration of the timing system before round 10 is fired from a weapon. Flywheel 34 and drive gear 36 are depicted in their respective initial safe positions and timing post 50 is depicted abutting support arm 42. Pivot shaft 46 protrudes upward as drawn from support arm 42 and through the central aperture formed in drive gear 36, allowing drive gear 36 to rotate in the plane of the paper. Gear teeth 36*a* are integrally formed in a radially inward edge of drive gear 36 and meshingly engage pinion gear 48. Clockwise rotation of drive gear 36 about pivot shaft 46 therefore causes counterclockwise rotation of flywheel 34 about firing pin 24 as gear teeth 36*a* engage pinion gear 48. The center of gravity of drive gear 36 is denoted 36*b*.

Flywheel centrifugal lock spring 52 has a first end 52*a* attached to upper housing 32 and a second end 52*b* that engages slot 54 formed in timing post 50, preventing flywheel 34 and timing post 50 from rotating about firing pin 24. When round 10 is fired from a weapon, centrifugal forces act upon flywheel centrifugal lock spring 52 and second end 52*a* thereof moves radially outwardly from slot 54 of timing post 50, thereby freeing flywheel 34 to rotate about firing pin 34.

FIG. 3 also depicts rotor release lock spring 60 having first end 60*a* secured to lower housing 30 and second end 60*b* disposed within slot 62 formed in peripheral edge of zip rotor 56. Rotor release lock spring 60 prevents the rotation of zip rotor 56 until the required arming time has elapsed after the round is fired from a weapon. Rotor release lock spring 60, when said second end is engaged in said slot, prevents zip rotor 56 from rotating about rotor shaft 58.

The center of gravity of zip rotor 56 is denoted 56*a* in FIG. 3.

FIG. 3 depicts timing post 50 in its unarmed starting position where it abuts support arm 42 as aforesaid. Upon disengagement of flywheel centrifugal lock spring 52 from slot 54 formed in timing post 50, said timing post travels in a counterclockwise circular path of travel around zip rotor 56. When timing post 50 contacts rotor release lock spring 60, it knocks second end 60*b* from slot 62 formed in zip rotor 56, thereby freeing zip rotor 56 to rotate about rotor shaft 58. Lock spring 52 could also engage flywheel 56 instead of slot 54 formed in timing post 50.

Figure 4:
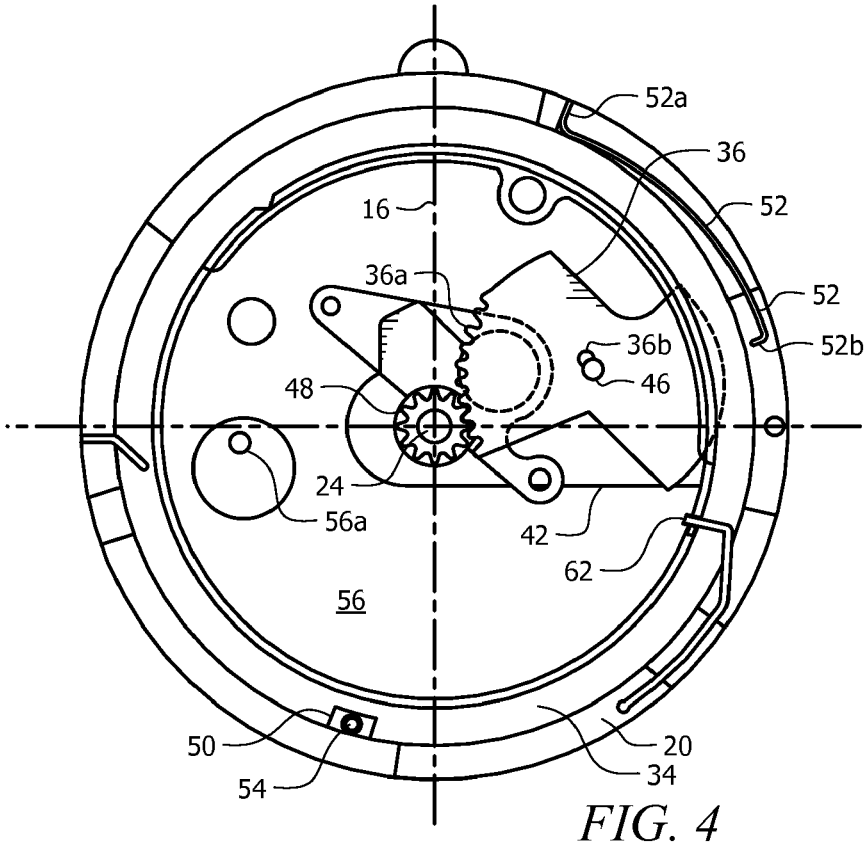
FIG. 4 is a view like that of FIG. 3 but where centrifugal force has caused a flywheel centrifugal lock spring to disengage from the flywheel.

FIG. 4 is a plan view depicting the configuration of the novel timing system shortly after round 10 has exited a weapon. Second end 52*b* of centrifugal force lock spring 52 has disengaged from slot 54 of timing post 50, thereby enabling but not causing rotation of flywheel 34. Centrifugal forces acting on drive gear 36 along a vector extending from centerline 16 through CG 36*b* of drive gear 36 cause clockwise rotation of drive gear 36 about pivot shaft 46. Meshing engagement between gear teeth 36*a* and pinion gear 48 causes flywheel 34 and timing post 50 to rotate counter clockwise about firing pin 24. Rotation of said flywheel and timing post ends when said timing post abuttingly engages the opposite side of support arm 42.

Figure 5:
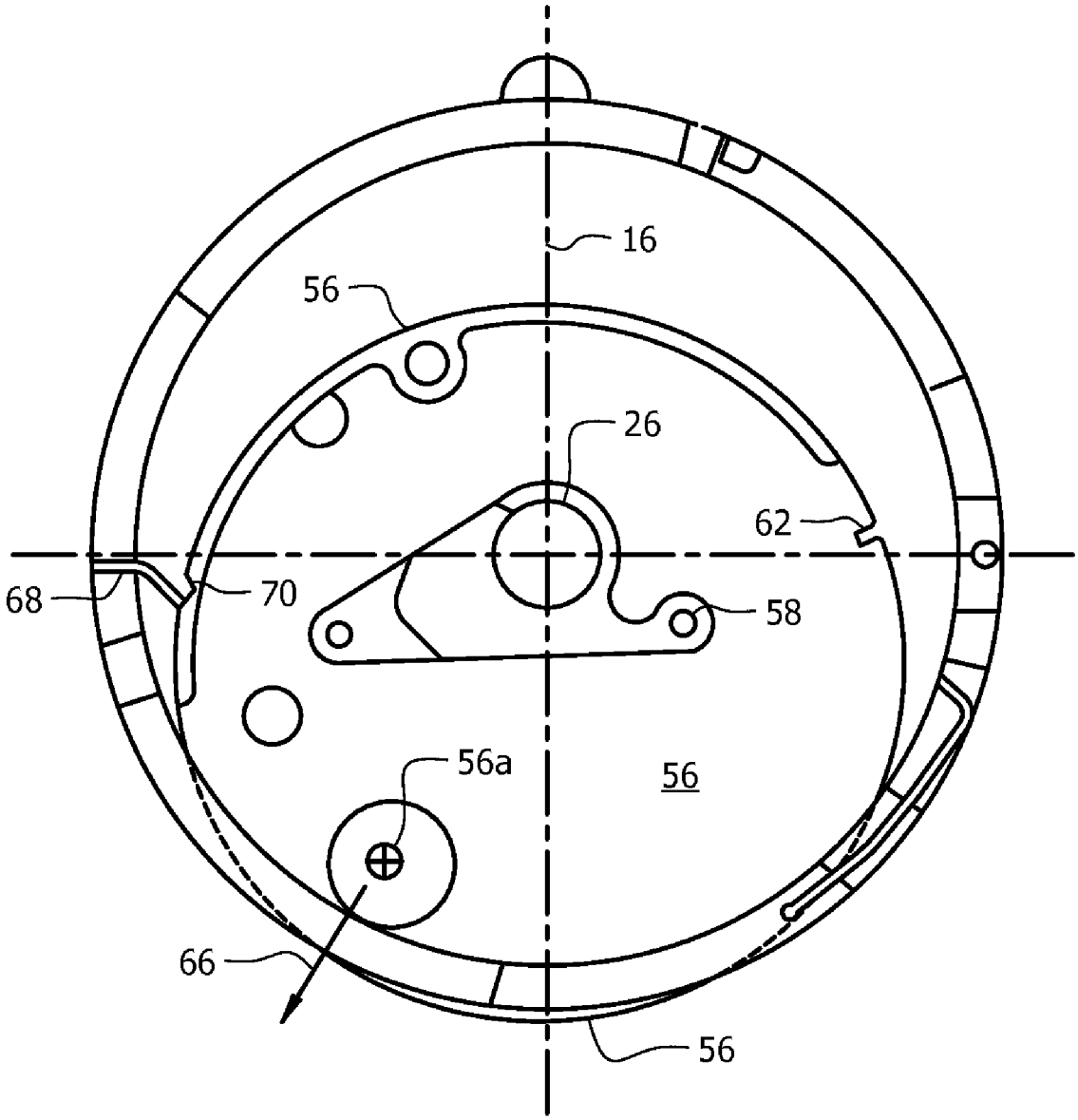
FIG. 5 is a transverse sectional view depicting the novel fuze in its fully armed configuration.

FIG. 5 depicts the arming system after zip rotor 56 has traveled to the armed position. The spin of round 10 and SAD produces centrifugal force vector 66 which is applied through CG 56*a* of zip rotor 56 in a radially outward direction relative to centerline 16. Force 66 causes zip rotor 56 to rotate about rotor shaft 58 in a counter clockwise direction, thereby positioning detonator 26 into alignment with centerline 16, firing pin 24, spitback 28, and main explosive charge 18. Before such rotation of zip rotor 56, detonator 26 was secured in an eccentric location away from said centerline 16, firing pin 24, spitback 28, and main explosive charge 18. Zip rotor 56 has sufficient mass to rotate from the unarmed to the armed position within a small fraction of a second, which is much less than the time required for timing post 50 to complete its orbit. As zip rotor 56 moves into the armed position, rotor arm lock 68 moves inward and engages slot 70 formed in the periphery of zip rotor 56, locking said zip rotor in position and preventing it from rotating in the clockwise direction.

Standard fuze safety regulations require that all SADs have at least minimum two safety locks that prevent the fuze from arming until it has been intentionally fired from a weapon. These safety locks must not be removed until the round has been subjected to "environments" that can only occur after a round has been fired from a weapon. The same regulations require that the two safety locks respond to independent and distinct environments. In this application of the command to arm fuze, one of the environments is the centrifugal forces generated by the rapid rotation of round 10 about centerline 16 which are typically in the range of twelve thousand revolutions per minute (12,000 rpm) for 40 mm ammunition. The radially inward bias of flywheel centrifugal lock spring 52, the first safety lock, prevents flywheel 34 from rotating. Centrifugal forces acting upon flywheel centrifugal lock spring 52 when round 10 is fired are sufficient to overcome the inward bias and displace second end 52*b* radially outward until it disengages flywheel 34.

Setback pin 57, disclosed in connection with FIG. 2, provides the second safety feature of command to arm fuze 12.

The first safety lock, flywheel centrifugal lock spring 52, cannot release flywheel 34 until a high rpm threshold has been reached. Flywheel 34 has a central center of gravity so that its release does not cause it to begin rotation. Drive gear 36, however, has a center of gravity eccentric to its axis of rotation about pivot shaft 46. Accordingly, as round 10 experiences high rpms, drive gear 36 is urged by centrifugal forces to rotate about said pivot shaft 46. However, by highly novel insight, drive gear 36 cannot respond to such centrifugal forces because drive gear teeth 36*a* are meshingly engaged with the teeth of pinion gear 48 which is secured to a central hub of flywheel 34. When flywheel 34 is released by flywheel centrifugal lock spring 52, drive gear 36 rotates instantaneously because it is already under bias to rotate as aforesaid. Rotation of drive gear 36 thus causes rotation of pinion gear 48 and conjoint rotation of flywheel 34 and timing post 50 that depends therefrom. Timing post 50 strikes second end 60*b* of rotor release lock spring 60 from slot 62 formed in zip rotor 56 and this frees said zip rotor to pivot quickly to the armed position due to its center of gravity 56*a* being eccentric from its axis of rotation as defined by rotor shaft 58.

The weight and CG of the drive gear are designed such that the torque generated by the rotation of the drive gear rotates the flywheel in a predetermined amount of time. The weight and inertia of the flywheel is designed such that the torque transferred through the pinion gear rotates the flywheel at a predetermined speed such that the zip rotor will not be released until the round has traveled to the desired arm distance. By not having the detonator located in the flywheel, the weight of the flywheel is kept to a minimum, thereby enabling the drive gear to be very small. Even though the drive gear is eccentrically pivoted, its low weight reduces the friction resulting from the spin of the projectile to a tiny fraction of what would be experienced in prior art fuzes. This lack of significant friction enables the fuze to perform consistently and have very little variation in arm time and said arm time can be accurately predicted and set by the design of the flywheel and drive gear.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A command to arm device, comprising:

a hollow housing having a rounded leading end, an open trailing end, and a longitudinal axis of symmetry;

a cylindrical upper housing disposed within said hollow main housing in concentric relation to said longitudinal axis of symmetry;

said cylindrical upper housing having an open top and an open bottom;

a lower housing disposed within said hollow main housing in concentric relation to said longitudinal axis of symmetry and having a flat bottom wall and a cylindrical sidewall mounted about the periphery of said flat bottom wall, projecting upwardly therefrom in supporting relation to said cylindrical upper housing;

a centrally bored flywheel rotatably mounted about an axis of rotation, said axis of rotation being concentric with said longitudinal axis of symmetry;

said flywheel having a center of gravity concentric with its axis of rotation;

a timing post depending from said flywheel into said lower housing in eccentric relation to said longitudinal axis of symmetry;

an actuator dome having a central aperture formed therein and having a peripheral edge that engages said upper housing;

a firing pin slideably received in said central aperture of said actuator dome and in said central bore of said flywheel in coincidence with said longitudinal axis of symmetry;

a zip rotor rotatably mounted about an axis of rotation, said zip rotor positioned atop said bottom wall of said lower housing;

said zip rotor having a center of gravity eccentric to its axis of rotation;

a detonator mounted in said zip rotor;

said zip rotor having a first, unrotated position of repose where said detonator is misaligned with said firing pin;

a first spring for preventing said flywheel from rotating when centrifugal forces acting on said first spring are below a preselected threshold; and a second spring for holding said zip rotor in said first, unrotated position of repose;

said first spring having a first end permanently secured to a cylindrical sidewall of said upper housing;

said first spring having a second end releasably secured to said flywheel;

said first spring being biased radially inwardly;

said bias of said first spring being overcome when centrifugal forces acting on said first spring exceed said predetermined threshold; and said flywheel being free to rotate about said firing pin when said bias of said first spring is overcome.

2. The device of claim 1, further comprising:

said flywheel having a central hub;

a pinion gear mounted on said central hub for conjoint rotation therewith;

a rotatably mounted drive gear having teeth that meshingly engage said pinion gear so that when said flywheel is held against rotation by said first spring, said drive gear is also held against rotation;

a pivot shaft about which said drive gear is rotatably mounted;

said drive gear having a center of gravity eccentric to said pivot shaft;

said drive gear rotating in a first rotational direction about said pivot shaft when said first spring releases said flywheel and hence said pinion gear;

said pinion gear and hence said flywheel being driven by said drive gear teeth to rotate in a second rotational direction opposite to said first rotational direction when said drive gear rotates in said first rotational direction.

3. The device of claim 2, further comprising:

said second spring having a first radially outward end permanently secured to a cylindrical sidewall of said lower housing and a second radially inward end releasably engaged to said zip rotor.

4. The device of claim 3, further comprising:

said timing post abutting said second end of said second spring and knocking said second end out if its releasable engagement with said zip rotor when said flywheel is rotated in said second rotational direction.

5. The device of claim 4, further comprising:

said zip rotor center of gravity causing it to pivot from said first, unrotated position of repose to an armed position when released from said first, unrotated position of repose by said timing post striking said second end of said second spring;

said detonator entering into axial alignment with said firing pin when said zip rotor is in said pivoted, armed position.

6. The device of claim 5, further comprising:

an actuator formed integrally with said hollow housing on an interior side of said rounded leading end;

said actuator being centered on said longitudinal axis of symmetry and being closely spaced apart from a head of said firing pin;

whereby when said hollow housing impacts against a hard target, said leading end of said hollow housing is deformed and said actuator is driven into said head of said firing pin.

7. The device of claim 6, further comprising:

a mounting pin depending from a bottom edge of said upper housing, said mounting pin being received within a bore formed in an upper edge of said lower housing;

a support arm having a first, radially outermost end secured to said mounting pin and a second, radially innermost end disposed radially inwardly from said mounting pin;

a firing pin aperture formed in said second, radially innermost end of said support arm;

said firing pin extending through said firing pin aperture.

8. The device of claim 7, further comprising:

a rotor shaft mounted in upstanding relation to said lower housing flat bottom wall;

a first end of said rotor shaft mounted in a blind bore formed in said lower housing flat bottom wall;

a first rotor shaft aperture formed in said zip rotor;

a second rotor shaft aperture formed in said support arm;

said rotor shaft extending through said first and second rotor shaft apertures.

9. The device of claim 8, further comprising:

an anti-creep spring having a first, radially outermost end secured to said mounting pin and a second, radially innermost end disposed in abutting relation to said zip rotor;

a rotor shaft aperture formed in said second end of said anti-creep spring so that said rotor shaft extends through said rotor shaft aperture;

whereby when said hollow housing impacts against a soft target and said hollow housing is not deformed by said impact so that said actuator is not driven into said firing pin, said zip rotor in its armed position slides along said rotor shaft in the direction of hollow housing travel when a sudden deceleration of said hollow housing occurs because of said soft target impact, said zip rotor overcoming the bias of said anti-creep spring and said detonator carried by said zip rotor impacting against said firing pin.

10. The device of claim 9, further comprising:

said drive gear being disposed in overlying, substantially parallel relation to said support arm;

said pivot shaft mounted to said support arm in upstanding relation thereto;

a pivot shaft aperture formed in said support arm, said pivot shaft extending through said pivot shaft aperture and said drive gear being pivotable about said pivot shaft.

11. The command to arm device of claim 10, further comprising:

a setback e-ring disposed in encircling relation to said hollow housing and said lower housing;

a first groove formed in a peripheral vertical wall of said hollow housing for accommodating a radially outward edge of said setback e-ring; and a second groove formed in a peripheral vertical wall of said lower housing for accommodating a radially inward edge of said setback e-ring;

said setback e-ring preventing relative movement between said hollow housing and said lower housing.

12. The command to arm device of claim 11, further comprising:

a spitback base plate disposed in underlying, supporting relation to said flat bottom wall of said lower housing;

said lower housing having a radially inwardly disposed flange that circumscribes a trailing end of said lower housing and that abuttingly engages a trailing wall of said spitback base plate to maintain said spitback base plate in abutting relation to said flat bottom wall of said lower housing.

13. The device of claim 12, further comprising:

a bore formed in a trailing side of said zip rotor;

a recess formed in said lower housing;

a setback pin having a head and a reduced diameter post, said head disposed in said recess and said reduced diameter post disposed in said bore;

a bias means for holding said reduced diameter post of said setback pin in said recess;

said setback pin maintaining said zip rotor in said first, unrotated position of repose until launch acceleration of a weapon overcomes the bias of said bias means and causes said reduced diameter post to withdraw from said recess and thereby unlock said zip rotor so that said zip rotor is free to rotate about said zip rotor shaft.

14. The device of claim 13, further comprising:

a central aperture formed in said spitback base plate;

a central aperture formed in said flat bottom wall of said lower housing;

a lead explosive positioned in said central aperture formed in said spitback base plate and in said central aperture formed in said flat bottom wall of said lower housing;

a leading end of said lead explosive disposed in open communication with said detonator when the device is armed;

a trailing end of said lead explosive disposed in open communication with a main charge;

whereby striking said detonator with said firing pin triggers detonation of said detonator, thereby triggering explosion of said lead explosive which then causes explosion of said main charge.

* * * * *